US007171790B2

(12) United States Patent
Mei

(10) Patent No.: US 7,171,790 B2
(45) Date of Patent: Feb. 6, 2007

(54) CLAMP UNIT FOR DO-IT-YOURSELF (DIY) SOLID WOOD FLOORING

(76) Inventor: Tzu-Chiang Mei, 5th Fl., 28, Alley 401, Lane 150, Hsin I Road, Sec. 5, Taipei City (TW)

( * ) Notice: Subject to any disclaimer, the term of this patent is extended or adjusted under 35 U.S.C. 154(b) by 276 days.

(21) Appl. No.: 10/805,186

(22) Filed: Mar. 22, 2004

(65) Prior Publication Data

US 2005/0204677 A1 Sep. 22, 2005

(51) Int. Cl.
*E04B 2/00* (2006.01)

(52) U.S. Cl. ..... 52/584.1; 52/582.1; 52/578

(58) Field of Classification Search ..... 52/584.1, 52/582.1, 578, 357, 519
See application file for complete search history.

(56) References Cited

U.S. PATENT DOCUMENTS 6,550,206 B2 * 4/2003 Lee ..... 52/480

* cited by examiner

*Primary Examiner*—Hugh B. Thompson, II
(74) *Attorney, Agent, or Firm*—Rosenberg, Klein & Lee

(57) ABSTRACT

The invention relates to a clamp unit for Do-It-Yourself (DIY) solid wood flooring having a first clamp, a second clamp and two spring clips. The first clamp includes a first protrusion, a T-shape protrusion disposed at the junction of two adjacent solid wood panels, and a tongue formed on the inner side of the first clamp and extended along a first clamp groove. The second clamp includes a second protrusion, a groove formed at the inner side of the second clamp and matching the tongue of the first clamp for engaging into each other, and a second clamp groove formed inside of the second clamp. The spring clips each include an opening mouth that fits tightly into the first and second grooves so that the first and second clamp are merged into one clamp unit. This allows the gap between the solid wood panels to automatically adjust and is suitable for irregular floor configurations.

3 Claims, 9 Drawing Sheets

CLAMP UNIT FOR DO-IT-YOURSELF (DIY) SOLID WOOD FLOORING

BACKGROUND OF THE INVENTION

1. Field of the Invention

The invention relates to a clamp unit for Do-It-Yourself (DIY) solid wood flooring, and more particularly, to a clamp which can automatically adjust its clamping structure in accordance with the expansion and contraction of the solid wood panels and is especially suited for wood flooring used to cover irregular shape floors.

2. Description of the Related Art

Solid wood flooring provides a durable surface that is widely received by house owners for its natural warmth and beauty. However, solid wood flooring is made up of separate wood panels laid side-by-side. Therefore, the gap left between each wood panel is of utmost importance and must rely on the craft and skill of the floor panel layer. If the panels are not laid properly, expansion and contraction will cause the panels to deform after a while, and the entire flooring must be changed. Because of this, labor costs are often much higher than the cost of the wood material, resulting in higher overall construction costs and additional financial burden to the user. Furthermore, floor panel layers are often hard to hire if the construction project is small or for only partial interior decoration.

As a result, DIY solid wood flooring has become increasingly popular. In order to make solid wood flooring DIY, installation methods must be easy and simple so that any consumer can lay the panels by himself. It is under these circumstances that a clamp unit for DIY solid wood flooring was invented.

FIG. 1 shows the commonly used clamp 1 for a DIY solid wood floor panel. The clamp is a square shaped piece of plastic made from a single mold that has a T-shape protrusion 11 in the center and two other protrusions 12, 13 on both sides. The installation position is shown in FIG. 2. Position the solid wood panel 2*b* at an angle so that its tongue 21 fits into the groove 22 of the other solid wood panel, then lay the panels flat down as shown in FIG. 3A. At this time, the clamp's 1 T-shape protrusion 11 now rests on the topside of the tongue 23 between solid wood panels 2*a* and 2*b*. Meanwhile, the protrusions 12, 13 on the two sides must fit into the grooves on the bottom side of solid wood panels 2*a* and 2*b*.

As the aforementioned commonly used clamp 1 is made from a single mold of plastic, the clamp's 1 design concept is to join solid wood panels 2*a* and 2*b* by fitting in to the grooves found on the bottom side of solid wood panels 2*a* and 2*b*, making it easy to install, but it also has its disadvantages. For example: When solid wood panel 2*b* is being installed close to the wall w, the clamp's 1 additional length L must be severed and removed, as depicted in FIG. 3B where only half of the clamp 1' is being used to support solid wood panel 2*b*'s outer bottom. Severing is no easy task for the DIY consumer, especially since the clamp 1 is made from hard plastic material and has a slippery surface. Consumers are often hurt when trying to sever the clamp.

In addition, the other disadvantage of the aforementioned clamp 1 is shown in FIGS. 4A, B, i.e. the reserved gap left between the conjunction points T1 when solid wood panels 2*a* and 2*b* are laid together. Moreover, there are a wide variety of solid wood panels, such as pinewood, redwood, oak wood, sandalwood, etc. Due to the characteristics of each type of wood, some solid wood panels will undergo significant changes from their own expansion and contraction under different types of environment, climate, or humidity. As shown in FIG. 4B, when the gap T2 between solid wood panels 2*a* and 2*b* open up because of their contraction, then the clamp 1 will easily break at the protrusions 12, 13 due to the pressure from both sides. This will affect the overall bondage strength of the wood flooring as well as its usage life.

Referring to FIG. 5, another type of commonly used DIY clamp is in the form of clamping tracks. A plurality of clamping tracks 3 in parallel are placed on the floor. Each clamping track 3 is made up of several individual clamp units 3*a*, 3*b*, 3*c*, 3*d*, 3*e* . . . 3*n* linked together. On the right side of each individual clamp is a clamp hook 31. The solid wood panels 2*a*, 2*b* . . . 3*n* are then placed and installed on top of their corresponding clamp units 3*a*, 3*b* . . . 3*n*.

The disadvantage to this type of clamping track 3 is that it must be laid out in parallel, i.e. it is only suited for square or rectangular shape floor spaces. Yet many homes have floor spaces that are irregularly configured circular or slanted, etc., which makes these types of clamps unsuitable. Due to its configuration limitations, these clamps are not widely used, which is one of its disadvantages. Another disadvantage of this type of clamp track 3 is shown in FIG. 6. The clamp hook 31 on each individual clamp unit 3*a* . . . 3*n* hooks only onto the right side tongue 23 of each solid wood panel 2*a* . . . 2*n*. The left side, on the other hand, has no clamp hooks. As such, there is no clamp hook on the last clamp unit 3*n* of the clamp track 3 to hold down the last piece of solid wood panel 2*n*. This allows the last solid wood panel to easily come off, leading to the problem of loose bondage between the solid wood panels.

In light of these problems, I, the inventor, have completed this invention after constant study and modifications to the commonly used clamp unit for DIY solid wood flooring.

SUMMARY OF THE INVENTION

It is a primary object of the invention to provide a clamp unit for DIY solid wood flooring. Each clamp unit is made up of two individual clamps laid side-by-side with a spring clip between the conjunction points. This allows each clamp to move in accord with the solid wood panel that is laid on top of it. There is no concern of breaking because the gap between the panels can be adjusted, thereby increasing its bondage strength as well as its usage life.

It is another object of the invention to provide a clamp unit for DIY solid wood flooring that can increase the convenience to the consumer. The two clamps that make up the single clamp unit can be separated and used individually, which allows the clamps to be applied to the front and back ends of the solid wood panels.

It is a further object of the invention to provide a clamp unit for DIY solid wood flooring which increases the scope of application because it can match the needs of various floor shape configurations.

BRIEF DESCRIPTION OF THE DRAWINGS

The accomplishment of this and other objects of the invention will become apparent from the following descriptions and its accompanying drawings of which.

DETAILED DESCRIPTION OF THE PREFERRED EMBODIMENT

Figure 7:
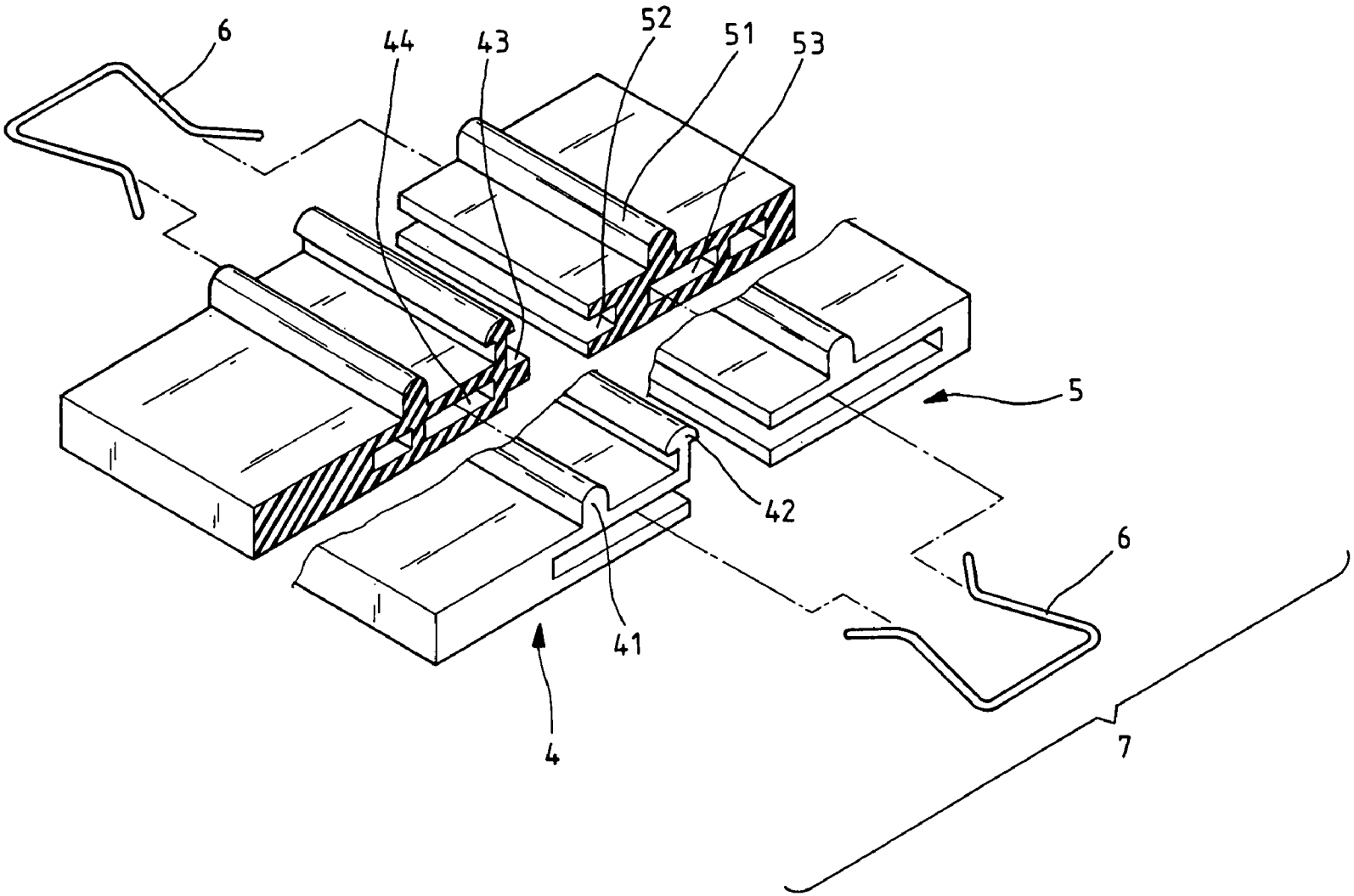
FIG. 7 is a perspective exploded view of the invention.
Figure 8:
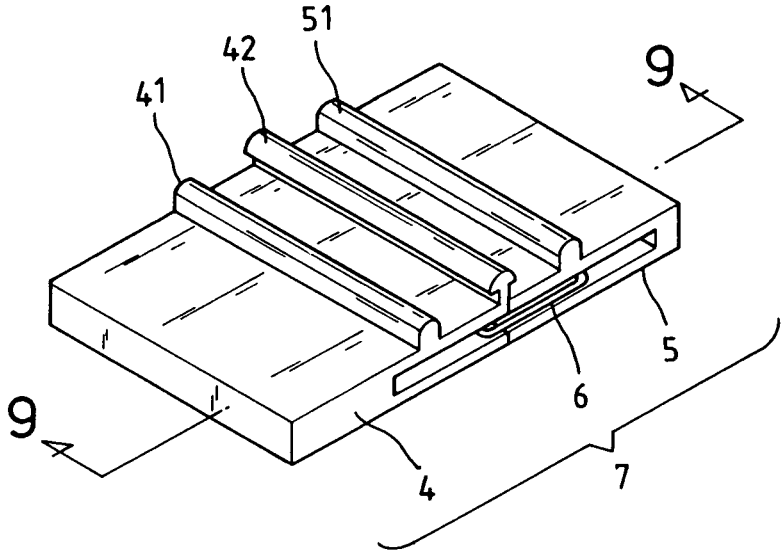
FIG. 8 is a perspective view of the invention after assembly.

First of all, referring to FIGS. 7 and 8, the clamp unit 7 in accordance with the invention includes a first clamp 4 and a second clamp 5, as well as two spring clips 6.

Figures 1, 2:
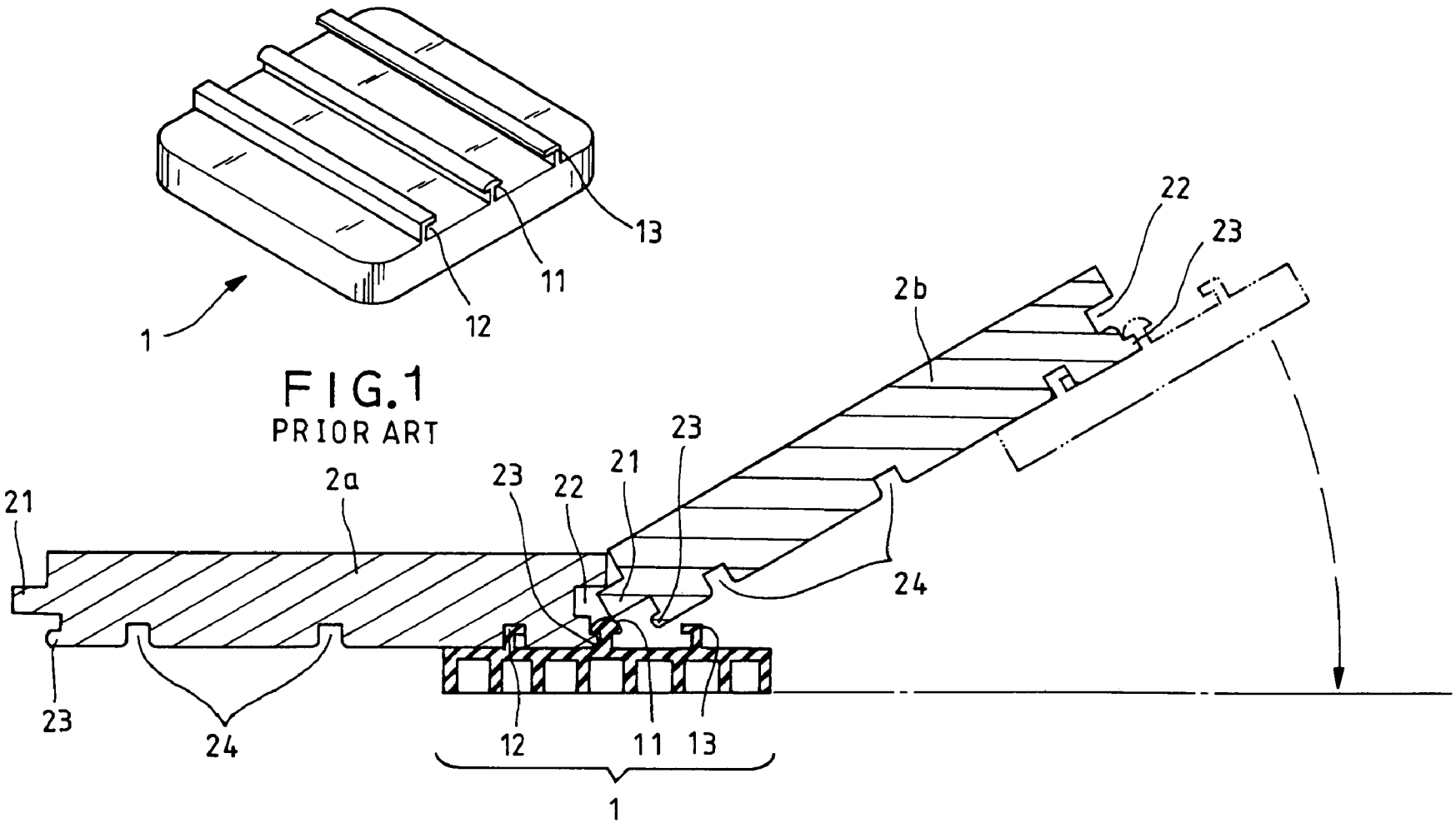
FIG.1 PRIOR ART
FIG.2 PRIOR ART
FIG. 1 is a perspective view of a conventional clamp unit.
FIG. 2 is a cutaway view of the conventional clamp unit of FIG. 1 in clamping the solid wood panels in position.
Figure 3:
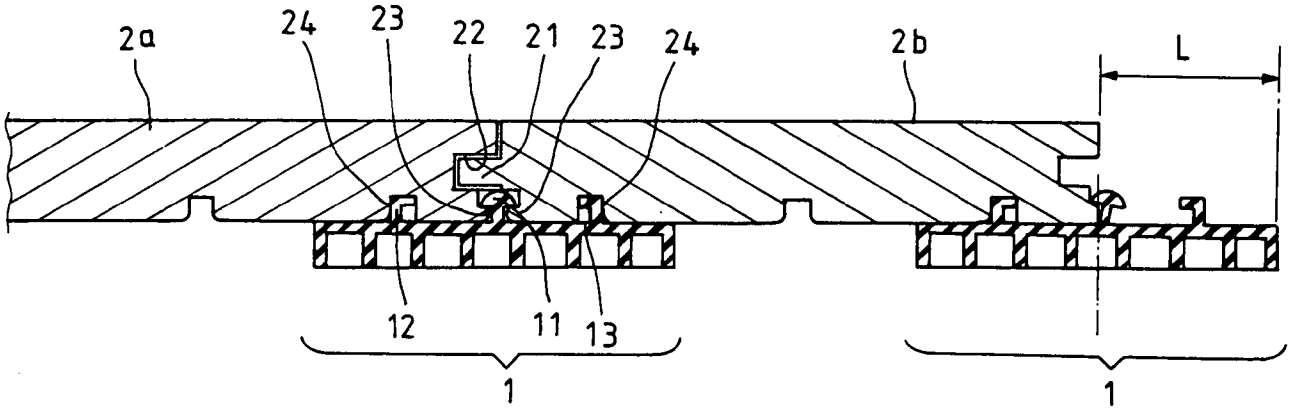
FIG. 3 (A) PRIOR ART
FIG. 3A is a first cutaway view of the conventional clamp unit of FIG. 1 after the solid wood panels are clamped in position.
FIG. 3B is a second cutaway view of the conventional clamp unit of FIG. 1 after the solid wood panels are clamped in position.
Figure 3:
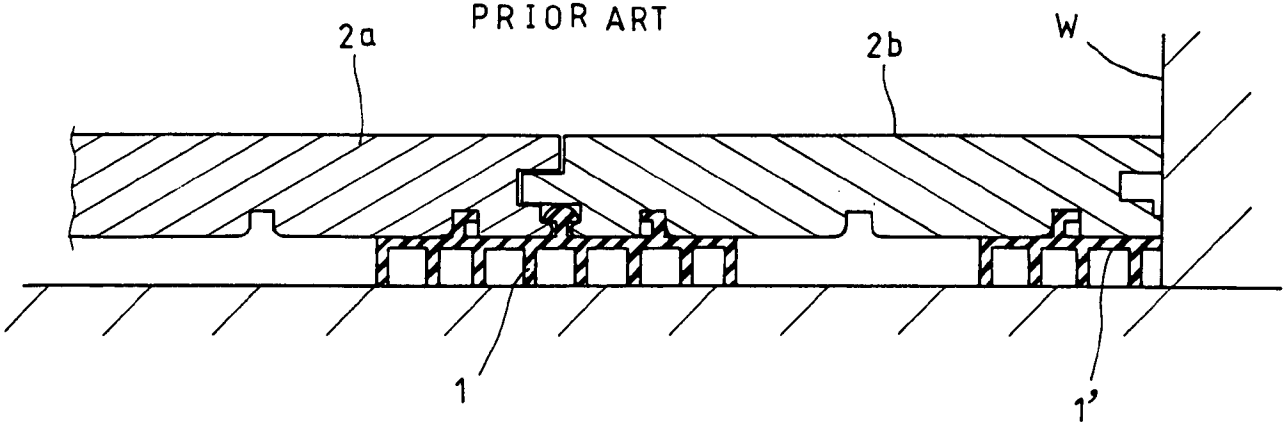
FIG. 3 (B) PRIOR ART
Figure 4:
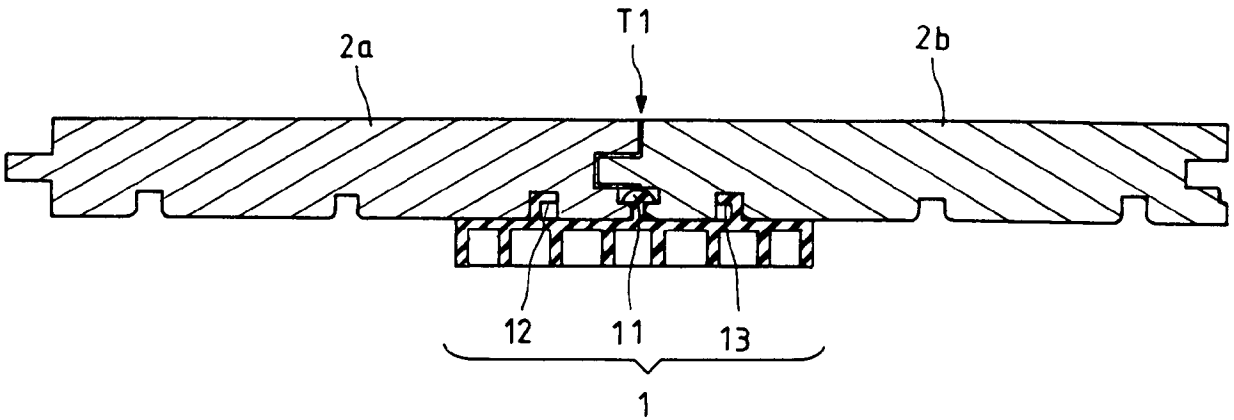
FIG. 4 (A) PRIOR ART
FIG. 4A is a third cutaway view of the conventional clamp unit of FIG. 1 after the solid wood panels are clamped in position.
FIG. 4B is a fourth cutaway view of the conventional clamp unit of FIG. 1 after the solid wood panels are clamped in position.
Figure 4:
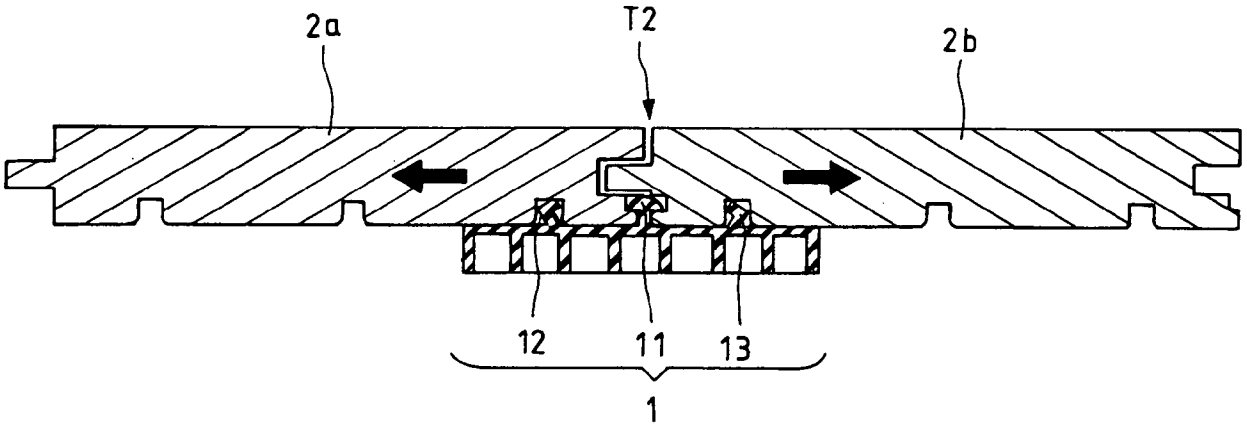
FIG. 4 (B) PRIOR ART
Figure 5:
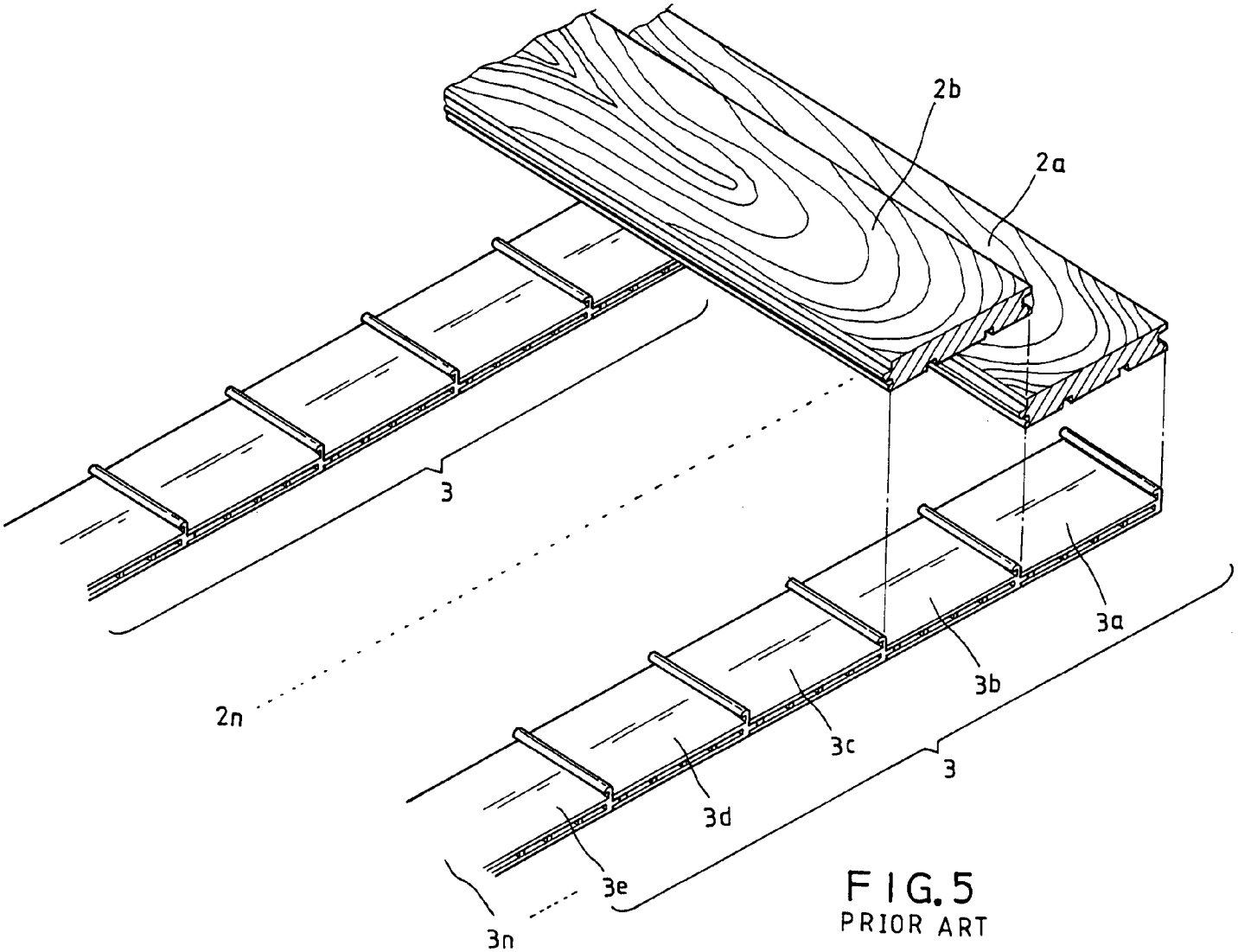
FIG. 5 PRIOR ART
FIG. 5 is a perspective view of another conventional clamp unit for DIY solid wood flooring.
Figure 6:
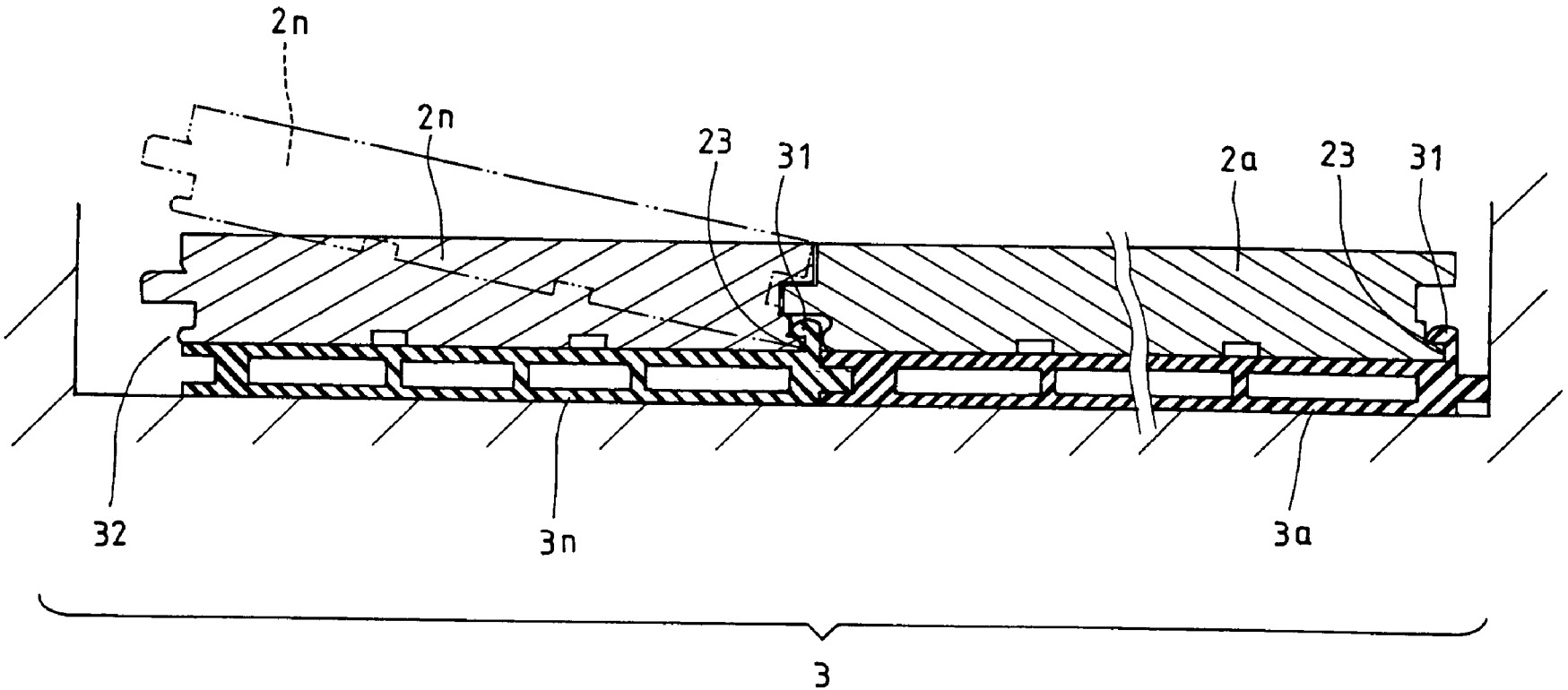
FIG. 6 PRIOR ART
FIG. 6 is a cutaway view of the conventional clamp unit of FIG. 5 in clamping the solid wood panels in position.

The upper surface of the first clamp 4 matches the groove side of a solid wood panel and has a first protrusion 41 on it. The mentioned solid wood panel is of regular market specification and installation technique as mentioned in FIG. 2 so that no further descriptions thereto are given hereinafter.

A T-shape protrusion 42 is disposed at the junction of two adjacent solid wood panels that matches the groove on the bottom side of the solid wood panel. Moreover, a tongue 43 is formed on its inner side of the first clamp 4 and extended along a first clamp groove 44.

Figure 11:
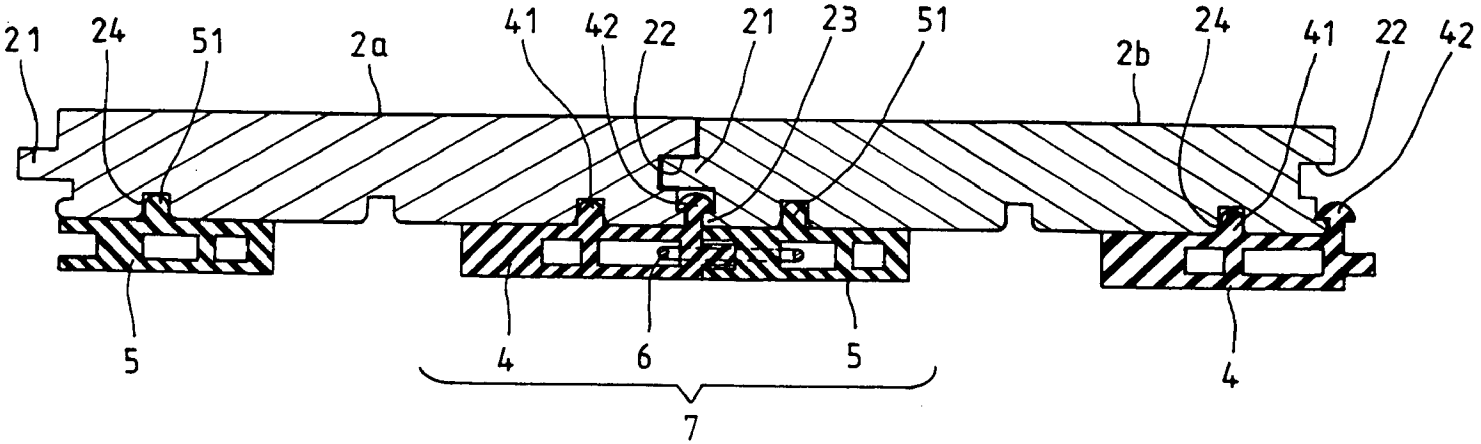
FIG. 11 is a first sectional view of the invention showing its advantage of flexible adjustment.
Figure 12:
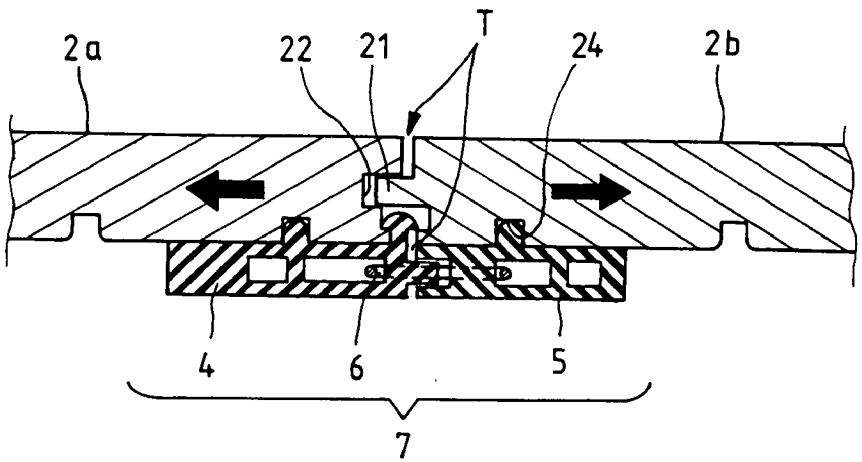
FIG. 12 is a second sectional view of the invention showing its advantage of flexible adjustment.

A second protrusion 51 is formed on the upper surface of the second clamp 5 that matches the groove on the bottom side of the solid wood panel as shown in FIGS. 11, 12. A groove 52 is formed at the inner side of the second clamp 5 and matches the tongue 43 of the first clamp 4 for engaging into each other. In addition, a second clamp groove 53 is formed inside the second clamp 5.

The mouth of the clips 6 fits tightly into the aforementioned first and second grooves 44, 53, so that the first clamp 4 and the second clamp 5 are merged into one clamp unit 7.

Figure 9:
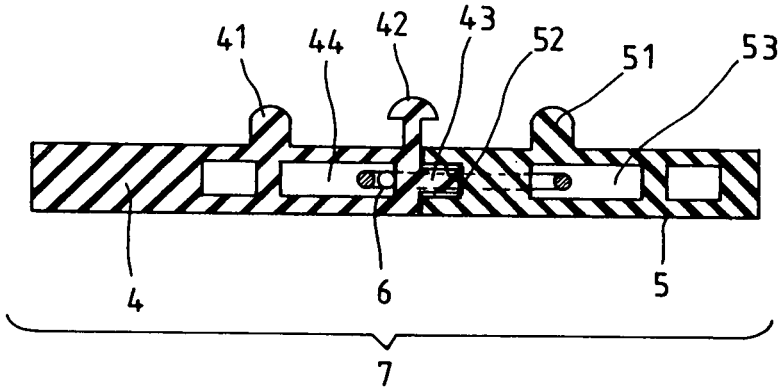
FIG. 9 is a sectional view taken along the line 9—9 of FIG. 8.

FIG. 9 is a cutaway view taken along the line of 9—9 in FIG. 8. Under normal conditions, the elasticity of the spring clip 6 forces the first and second clamp 4, 5 to fit together.

Figure 10:
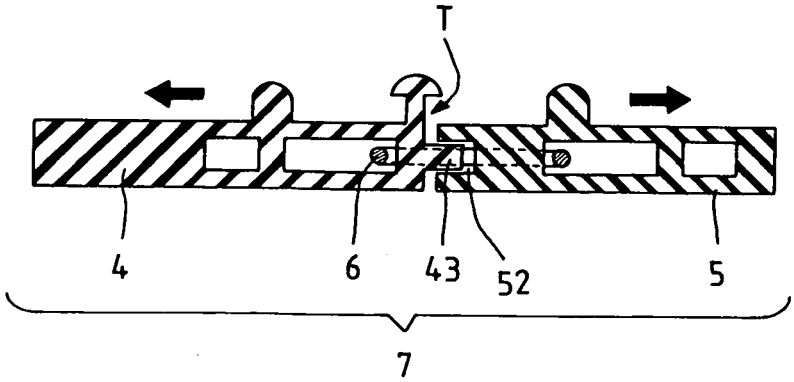
FIG. 10 is a sectional view of the invention applied to the expanded solid wood panels.

As shown in FIG. 10, when the first and second clamps 4, 5 are pulled away from each other, a gap T is formed at the conjunction point. This invention is designed so that the gap T is allowed to open up to about 5 mm. Therefore, the connection depth between the tongue 43 and groove 52 needs to be about 2~6 mm.

Based on this technical advancement, the clamp unit 7 of the invention becomes an elastic merged device that can be flexibly adjusted. One of its usage conditions is shown in FIG. 11 where the entire clamp unit 7 is fitted into the conjunction points underneath the two adjacent solid wood panels 2*a*, 2*b*. Its installation technique is the same as described for clamp 1, but without the disadvantages of clamp 1, i.e. the first and second clamps 4, 5, which make up the clamp unit 7, can be taken apart and used separately on the right side and left bottom side of the solid wood panels to support the ends of the panels. The user does not have to saw apart the clamp during DIY installation of the wood flooring, making it not only very convenient to use, but also very safe.

Another advantage of this invention is depicted in FIG. 12. When the two adjacent solid wood panels 2*a*, 2*b* are affected by the environment or climate and begin to expand/contract, the clamp unit 7 can adjust the gap T between the two solid wood panels 2*a*, 2*b*, i.e. the first and second clamps 4, 5 will flexibly move along with its solid wood panel. This reduces the concern of breaking and can ensure its usage life as well as strengthen the bondage between the solid wood panels.

Figure 13:
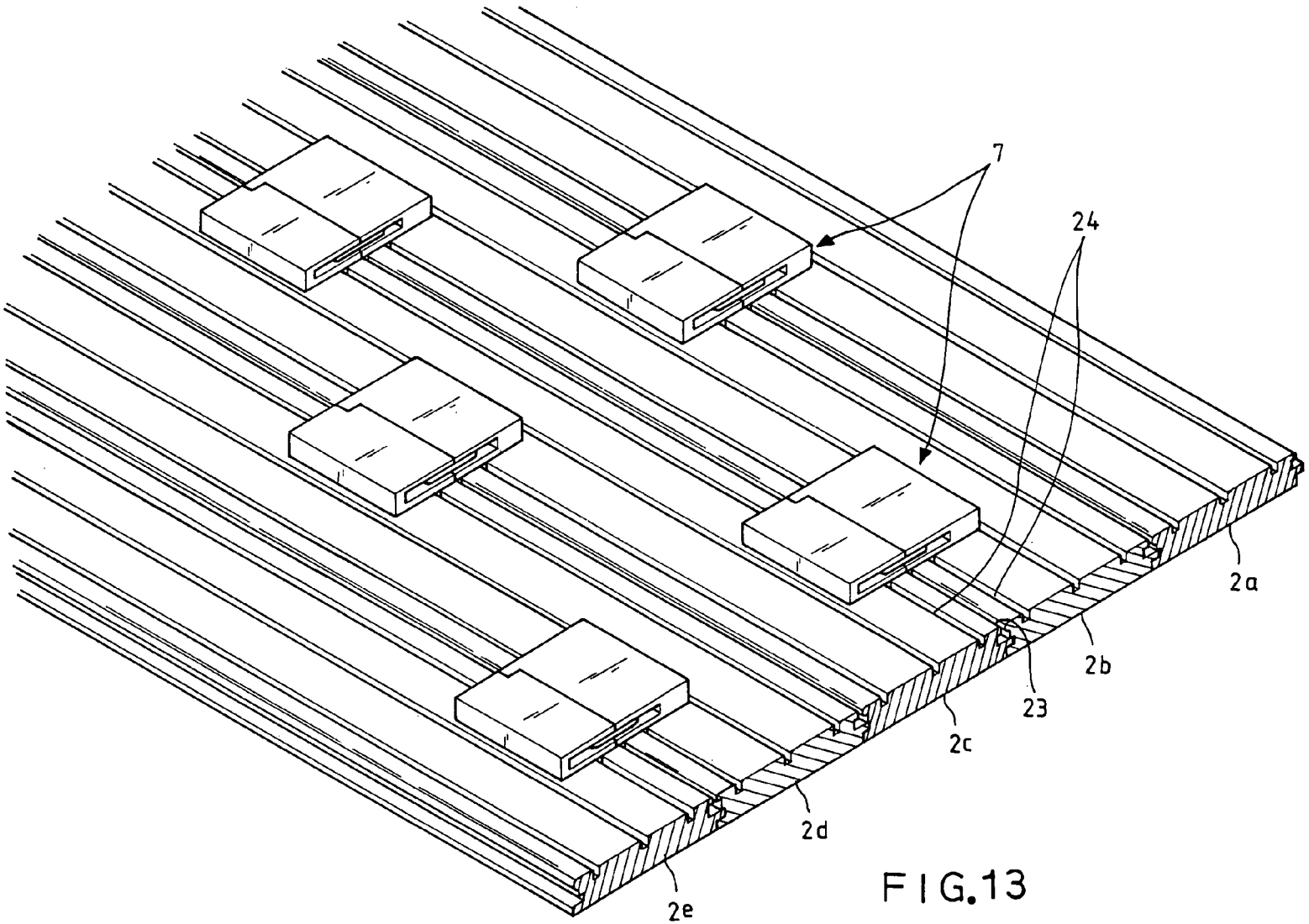
FIG. 13 is a bottom view of the invention after clamping the solid wood panels in position.

Referring to FIG. 13, which is a view of the bottom side of the solid wood panels 2*a*, 2*b*, . . . , 2*e* after they are installed and fitted. From this diagram, the clamp unit 7 is fitted on to the conjunction point between two adjacent solid wood panels and can slide along the tongue 23 and groove 24 into the most optimal spot so that each clamp unit 7 can be fitted according to need and is not restricted by configuration limitations. Compared to the commonly used clamp tracks 3, this invention has a much wider scope of usage and is even more suited for home DIY usage.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A clamp unit for solid wood flooring comprising:

a first clamp having a first end and an opposing second end, said first clamp having a first protrusion disposed on a top surface thereof and matches one of the grooves of a solid wood panel; a tongue formed on an inner side of the first end of said first clamp and extended along a first clamp groove;

a second clamp having a first end and an opposing second end, said second clamp having a second protrusion disposed on a top surface thereof and matches another groove of solid wood panel; a groove formed on an inner side of the first end of said second clamp and corresponding to the tongue of the first clamp for mating engagement therewith; a second clamp groove formed inside of the second clamp; and spring clips each having an opening mouth that fits tightly into the first and second grooves respectively and securing said first and second clamps each to the other at their respective first ends thereby forming one clamp unit; and a T-shaped protrusion disposed on an upper surface of said clamp unit at a junction defined by said first end of said first clamp and said first end of said second clamp, said junction of said first and second clamps positioned directly below a junction of adjacent wood panels.

2. The clamp unit for solid wood flooring as recited in claim 1 wherein the connection depth between the tongue of the first clamp and the groove of the second clamp is within the range from 2 mm to ~6 mm for allowing the expansion/contraction of adjacent solid wood panels.

3. The clamp unit solid wood flooring as recited in claim 1 wherein the clamp unit is separable into two individual members serving as support at the bottom of the side of the solid wood panel.

* * * * *